US007621430B2

(12) United States Patent
Schawbel

(10) Patent No.: US 7,621,430 B2
(45) Date of Patent: Nov. 24, 2009

(54) GARMENT REFRESHING HANGER

(75) Inventor: Arthur Edward Schawbel, Needham, MA (US)

(73) Assignee: Market Reconnaissance Group, LLC, Needham, MA (US)

( * ) Notice: Subject to any disclaimer, the term of this patent is extended or adjusted under 35 U.S.C. 154(b) by 0 days.

(21) Appl. No.: 11/955,726

(22) Filed: Dec. 13, 2007

(65) Prior Publication Data

US 2009/0152310 A1 Jun. 18, 2009

(51) Int. Cl.
*A41D 27/22* (2006.01)

(52) U.S. Cl. ..... 223/86; 223/85; 223/88; 223/92; 223/98

(58) Field of Classification Search ..... 223/85, 223/86, 98, 88, 92
See application file for complete search history.

(56) References Cited

U.S. PATENT DOCUMENTS

| | | | | | |
|---|---|---|---|---|---|
| 1,615,748 | A | * | 1/1927 | Fischer | 223/86 |
| 1,981,072 | A | * | 11/1934 | Roman et al. | 223/86 |
| 2,139,404 | A | * | 12/1938 | Evans | 223/86 |
| 2,407,015 | A | * | 9/1946 | Harrison | 223/86 |
| 3,153,499 | A | * | 10/1964 | Babiskin et al. | 223/88 |
| 3,739,558 | A | | 6/1973 | Hurson | |
| 3,790,044 | A | | 2/1974 | Verdile | |
| 4,768,686 | A | * | 9/1988 | Storti | 223/86 |
| 4,886,010 | A | | 12/1989 | Stutzman | |
| 5,019,254 | A | | 5/1991 | Abrevaya et al. | |
| 5,154,960 | A | | 10/1992 | Mucci et al. | |
| 5,907,908 | A | * | 6/1999 | Cunanan et al. | 34/61 |
| 2005/0120757 | A1 | | 6/2005 | Jackson | |
| 2006/0124477 | A1 | * | 6/2006 | Cornelius et al. | 206/278 |
| 2006/0169796 | A1 | * | 8/2006 | Timpson et al. | 239/53 |
| 2007/0071933 | A1 | * | 3/2007 | Gavelli et al. | 428/43 |

FOREIGN PATENT DOCUMENTS

| | | | | |
|---|---|---|---|---|
| JP | 11239676 | | | 9/1999 |
| JP | 11244125 | | | 9/1999 |
| JP | 2000237029 | | | 9/2000 |
| JP | 2000237029 | A | * | 9/2000 |
| JP | 2001112606 | A | * | 4/2001 |
| JP | 2002053180 | | | 2/2002 |
| JP | 2002058583 | A | * | 2/2002 |
| JP | 2003154197 | | | 5/2003 |
| JP | 2004131912 | A | * | 4/2004 |

* cited by examiner

*Primary Examiner*—Gary L Welch
*Assistant Examiner*—Nathan E Durham
(74) *Attorney, Agent, or Firm*—Albert Peter Durigon

(57) ABSTRACT

Garment refreshing hangers incorporate activated charcoal, a proven odor absorbing material, into the body of the hanger. Garments such as a jacket are hung on the hanger in the traditional manner. The garment areas susceptible to odor producing body areas like the neck and armpits are placed in close proximity to the activated charcoal in the hanger. The activated charcoal absorbs the odors thus removing them from the garment. Provision is made for charcoal replacement upon consumption. Preferably, the charcoal includes activated carbon impregnated porous sheet material.

7 Claims, 15 Drawing Sheets

GARMENT REFRESHING HANGER

FIELD OF THE INVENTION

This invention is drawn to the field of apparel apparatus, and more particularly, to a novel garment refreshing hanger.

BACKGROUND OF THE INVENTION

Wearing a garment several times in a row can be economical (save dry cleaning costs), beneficial to the environment (less chemicals and/or water used) and also prolong the life span of the clothing. With these benefits comes the challenge of keeping the shirt, dress, jacket or other garment smelling fresh on the subsequent wearings.

Heretofore, there have been attempts to deodorize garments individually as well as collectively by exposure to activated carbon. The collective techniques are exemplified by the garment bag having an inlet filter of US publication 2005/0120757 to Jackson, published Jun. 9, 2005; the dehumidifier pouch having desiccating and/or odor absorbing components of U.S. Pat. No. 5,907,908 to Cunanan et al., published Jun. 1, 1999, that may be hung in a closet; and the cover for a hanger for a wash that includes activated carbon for odor control of JP2003154197 to Tomoko, published May 27, 2003. The collective techniques, however, are disadvantageous, in that they tend to be costly; utilize a great deal of closet real estate; and are less than easy and straightforward to use or maintain.

The individual garment techniques heretofore are exemplified by JP2000237029 to Takayuki, published Sep. 5, 2000; JP11239676 to Atsuko, published Sep. 7, 1999; JP11244125 to Sakuji, published Sep. 14, 1999; and JP2002053180 to Yoichi, published Feb. 19, 2002. JP2000237029 discloses a hanger and accessory tool for the same having a charcoal bag that is removably mounted to the main body of the hanger. JP11239676 discloses a charcoal chip containing hanger shaped as a toy animal having a deodorizing/dehumidifier effect. JP11244125 discloses deodorant sheets for hangers that include activated carbon. JP2002053180, likewise, discloses active charcoal clothes storing sheets usable with hangers. However, the heretofore known charcoal bag and chip individual garment deodorizing techniques have been less than effective to absorb odors from high odor areas such as neck or garment underarm areas; have been costly to manufacture; and/or have been difficult to use or replace. Although the heretofore known deodorant sheets have a much higher odor absorbing effectivity than charcoal bags and charcoal chips due to their greater cross-sectional area and more open air flows, their comparatively large size makes them not only expensive and difficult to use, manipulate and store but also inefficient and wasteful, as it is typically the upper parts of a garment that need deodorizing the most.

SUMMARY OF THE INVENTION

It accordingly is one object of the present invention to disclose garment refreshing hangers effectively absorbing odors from garment's underarm, neck and other target areas most likely to contain odors.

Another object of the present invention is to disclose garment refreshing hangers that are efficient and minimize waste, using no more odor absorbing material than necessary to effectively absorb odors from the targeted areas.

It is a further object of the present invention to disclose garment refreshing hangers that are low in cost and as easy to use and store as ordinary garment hangers.

The garment refreshing hangers in accord with these and other objects of the present invention include hanger and odor absorbing elements; the hanger element including a suspension head and garment suspension arms connected to the suspension head shaped to provide a hollow torso below and between the garment suspension arms defining an air plenum in which garment odors may accumulate by air convection; the odor absorbing element including activated carbon material conformably shaped to the hollow torso and substantially coextensive with the air plenum below and between the garment suspension arms to absorb garment odors that waft into the air plenum of the hollow torso by air convection from underarm, neck and other target high odor areas. The activated carbon sheet material conformably shaped to and substantially coextensive with at least a major portion of the plenum or "odor triangle" between the armpit and neck areas also actively promotes odor migration from the target areas due to the attractive physical properties of activated carbon to pull odors from the targeted high odor areas.

The hanger and odor absorbing elements of the garment refreshing hangers of the present invention may be variously embodied in different replaceable and/or disposable configurations. In one presently preferred embodiment, the hanger element includes an open bottom web and the odor absorbing element is a replaceable, activated carbon filter cartridge that is slidably receivable by said open bottom web.

In another presently preferred embodiment, the hanger element includes a wire hanger member, and the odor absorbing element includes a replaceable clam case that is pivotally attachable about the wire hanger member.

In another presently preferred embodiment, the hanger element includes a wire hanger member, and the odor absorbing element includes a jacket that slidably receives and is seated upon the wire hanger member.

In a further presently preferred embodiment, the hanger element includes a wire hanger member, and the odor absorbing element includes a resilient skirt that is stretched over and attached to the wire hanger member.

The activated carbon material in any embodiment preferably is a long lasting activated carbon impregnated fabric.

In any embodiment, clothing odors from target high odor neck and underarm areas are effortlessly reduced if not eliminated simply by the mere fact of being hung. Additionally, the garment refreshing hangers will also deodorize the closet in which the hangers are used and will reduce the content of chemicals remaining on the clothes from the dry cleaning process. Another benefit is that the life of clothing can be prolonged by promoting additional wearings and less frequent dry cleaning or washing.

BRIEF DESCRIPTION OF THE DRAWINGS

These and other objects, advantageous features and inventive aspects will become apparent as the invention becomes better understood by referring to the following, solely exemplary, detailed description of the presently preferred embodiments thereof, and to the drawings, wherein.

DETAILED DESCRIPTION OF THE PRESENTLY PREFERRED EMBODIMENTS

Figure 1:
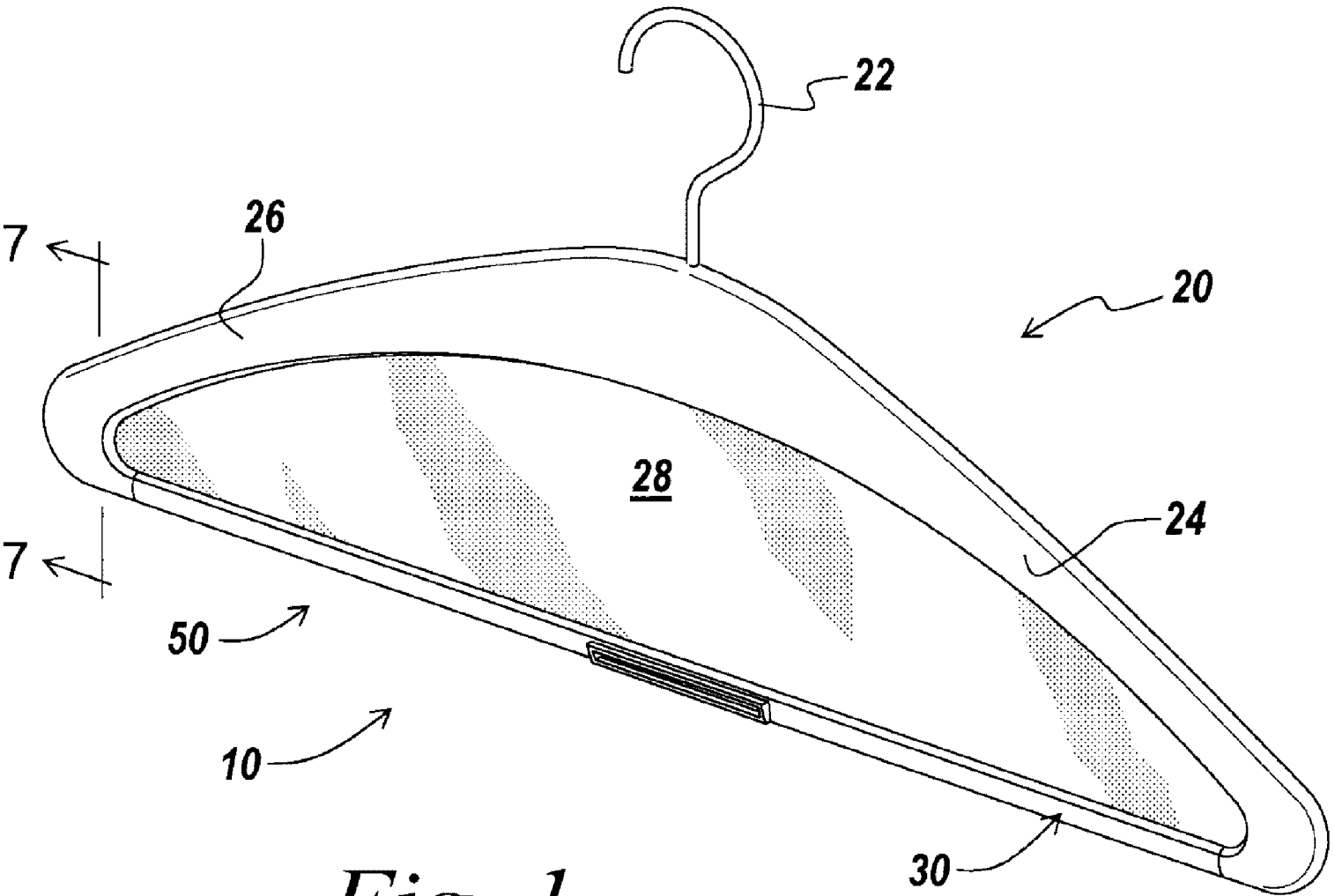
FIG. 1 is a front perspective view of one presently preferred embodiment of a garment refreshing hanger in accord with the present invention.
Figure 2:
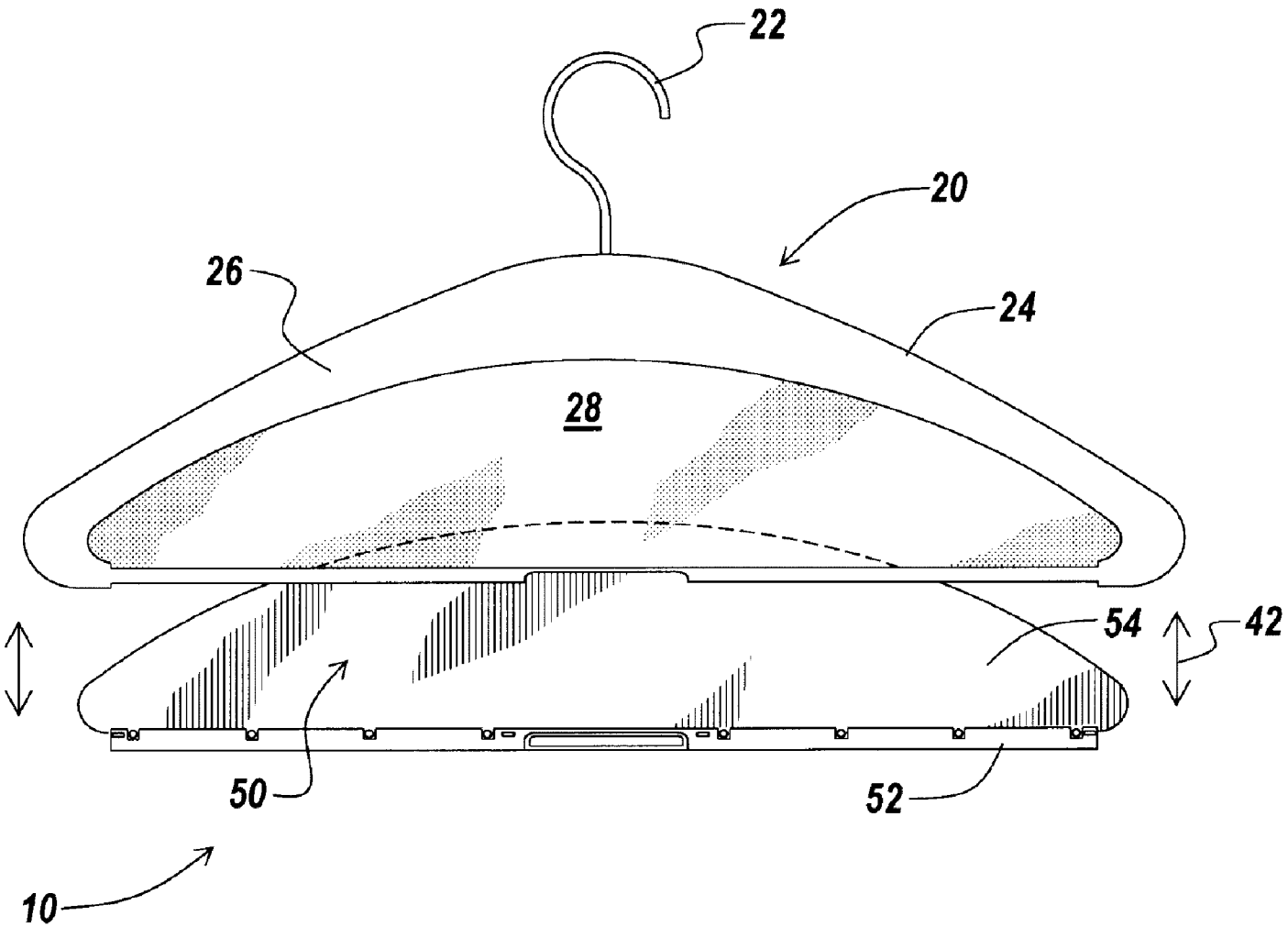
FIG. 2 is a front plan view thereof, showing the removable odor absorbing element in partially inserted condition.
Figure 3:
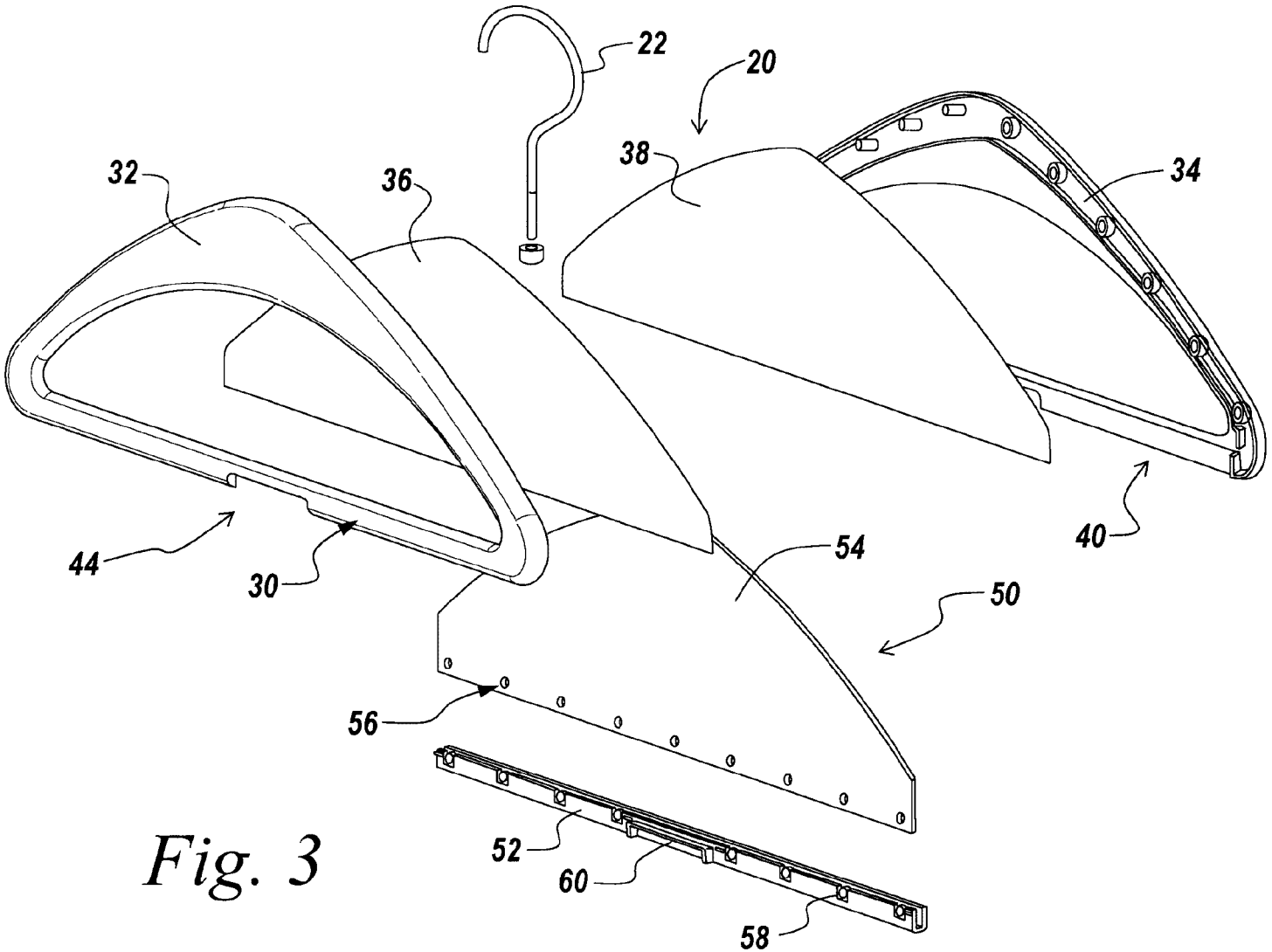
FIG. 3 is an exploded perspective view thereof.
Figure 4A:
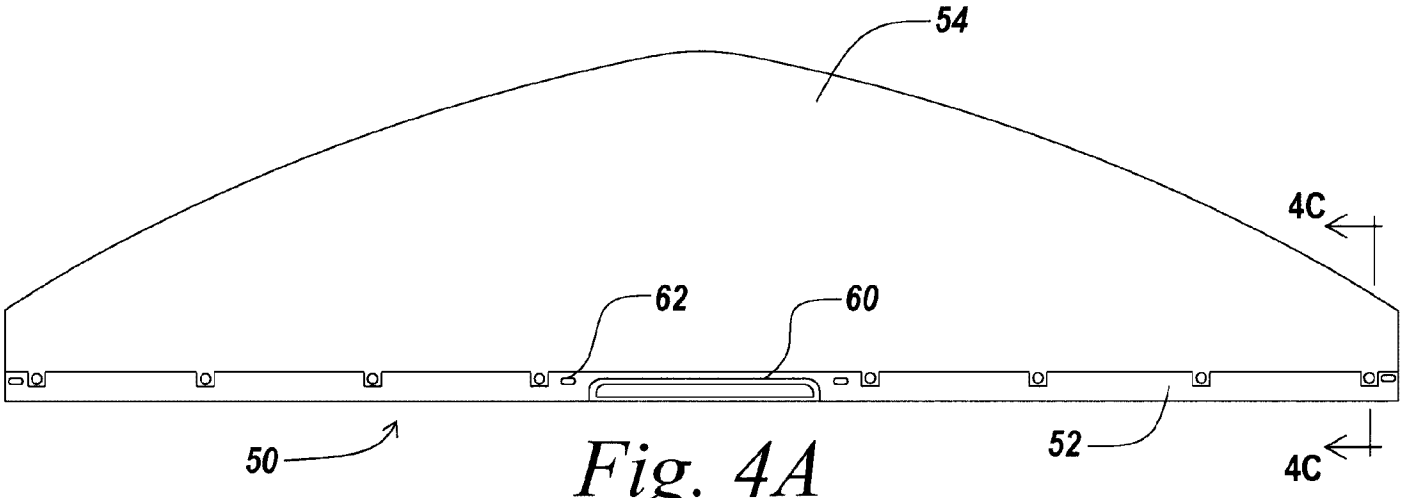
FIG. 4 illustrates front plan, bottom plan and side sectional views of the replaceable odor absorbing element respectively in the FIGS. 4A, 4B, 4C thereof.
Figure 4B:
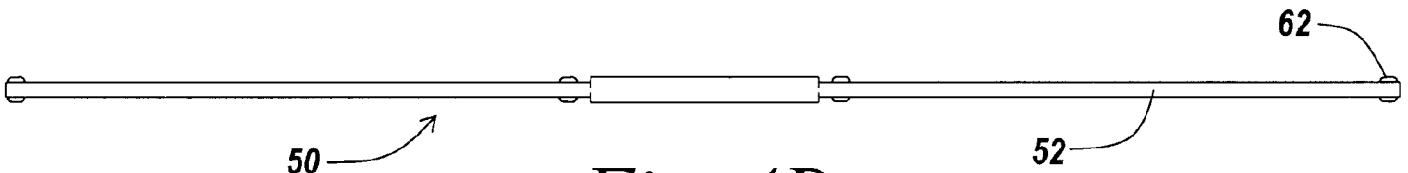
Figure 4C:
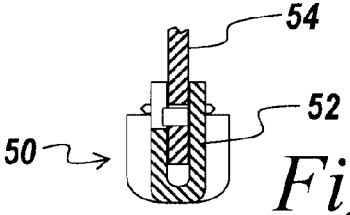
Figure 6:
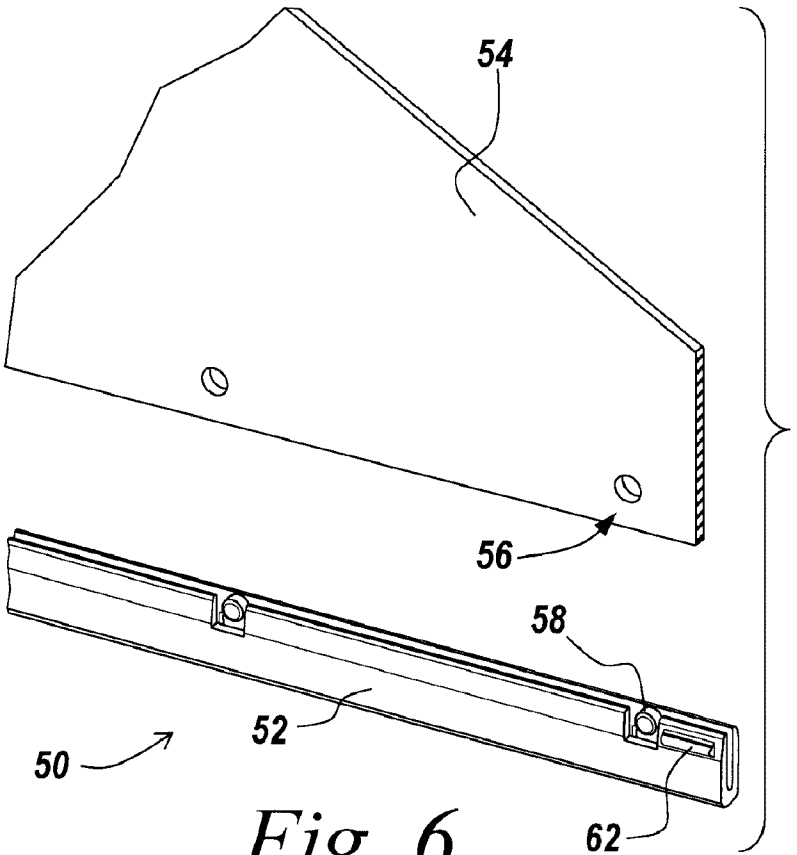
FIG. 6 is a detailed exploded view of an end of the replaceable odor absorbing element thereof.
Figure 5:
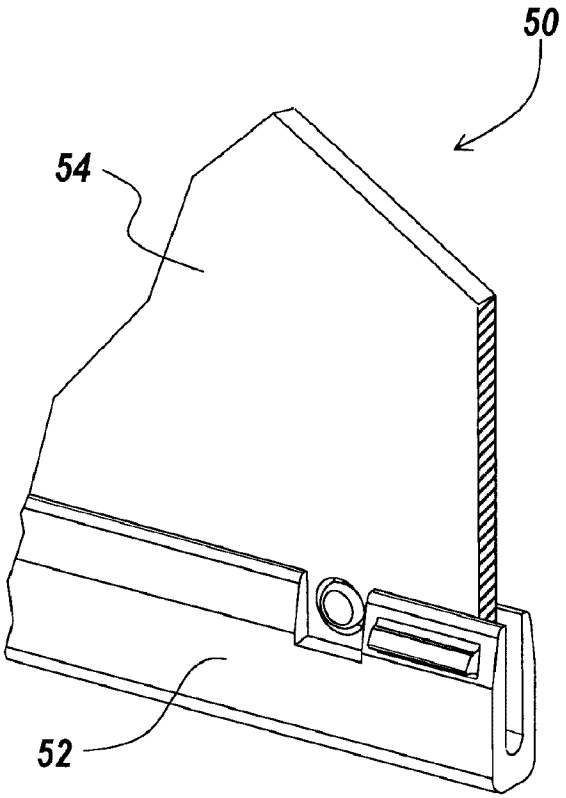
FIG. 5 is a detailed perspective view of an end of the replaceable odor absorbing element thereof.
Figure 7:
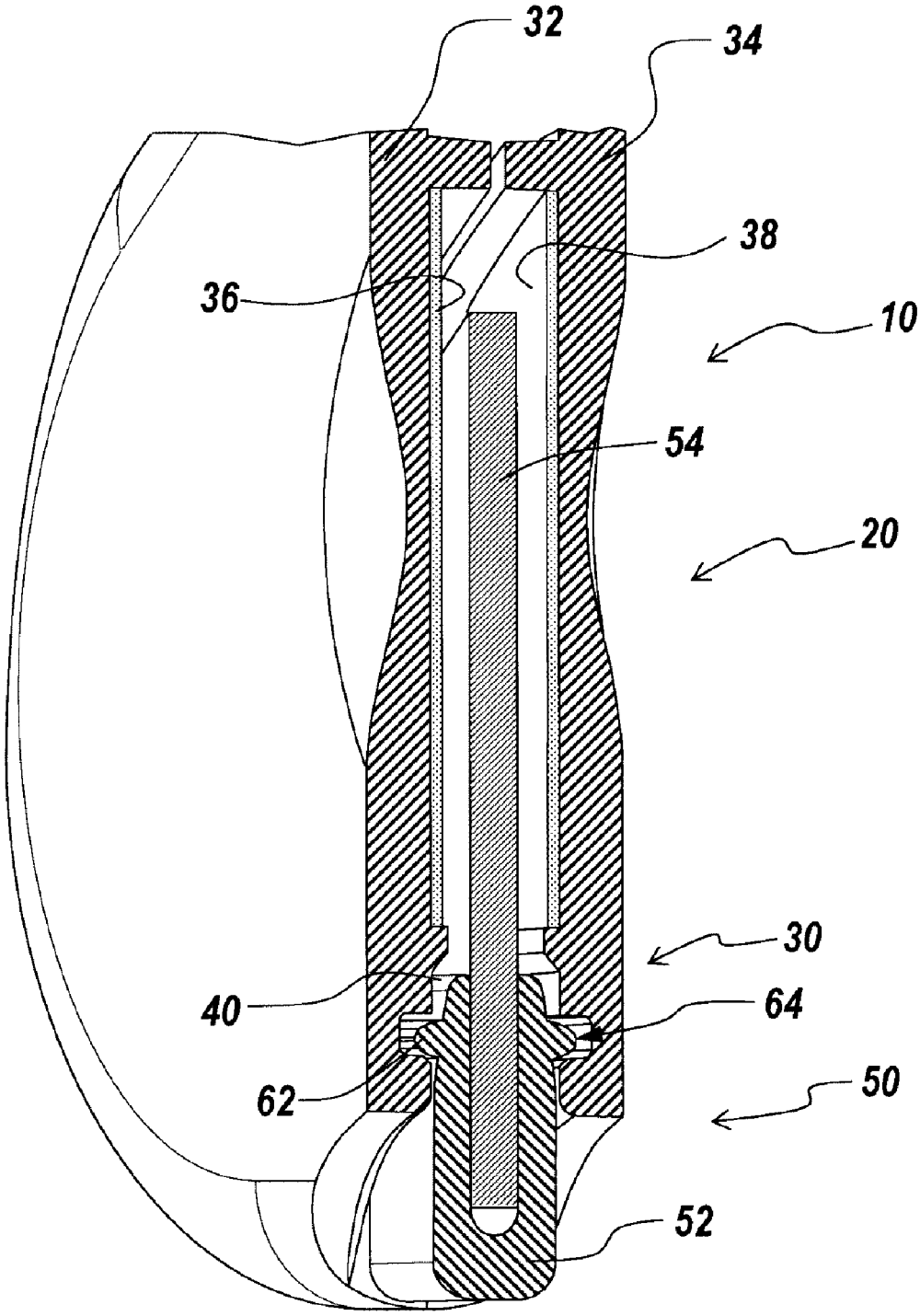
FIG. 7 is a sectional view thereof taken along the lines 7-7 of FIG. 1.
Figure 8:
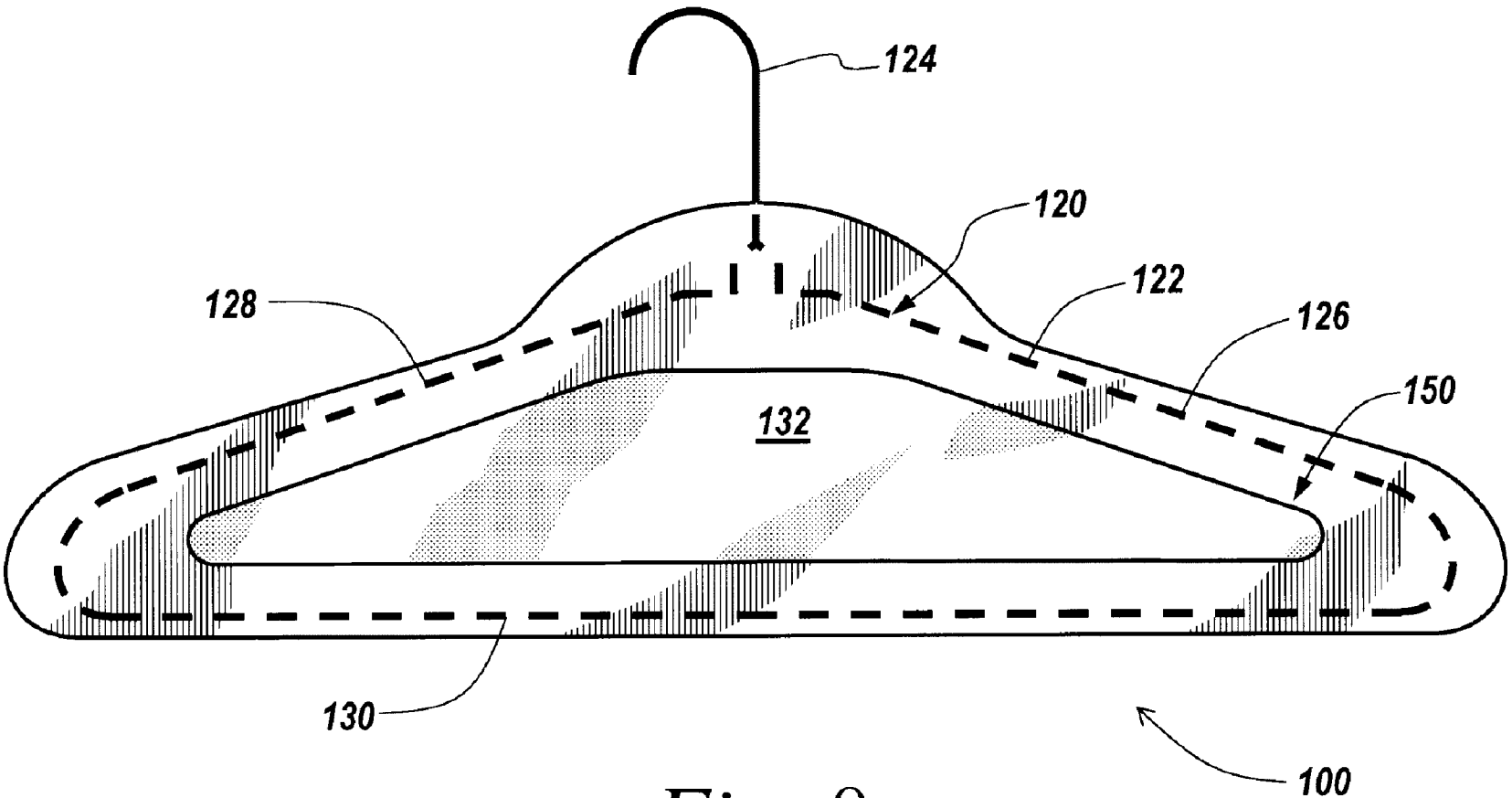
FIG. 8 is a front plan view of another presently preferred embodiment of a garment refreshing hanger in accord with the present invention, wherein the odor absorbing element includes a clam case removably attached to the hanger element.
Figure 9:
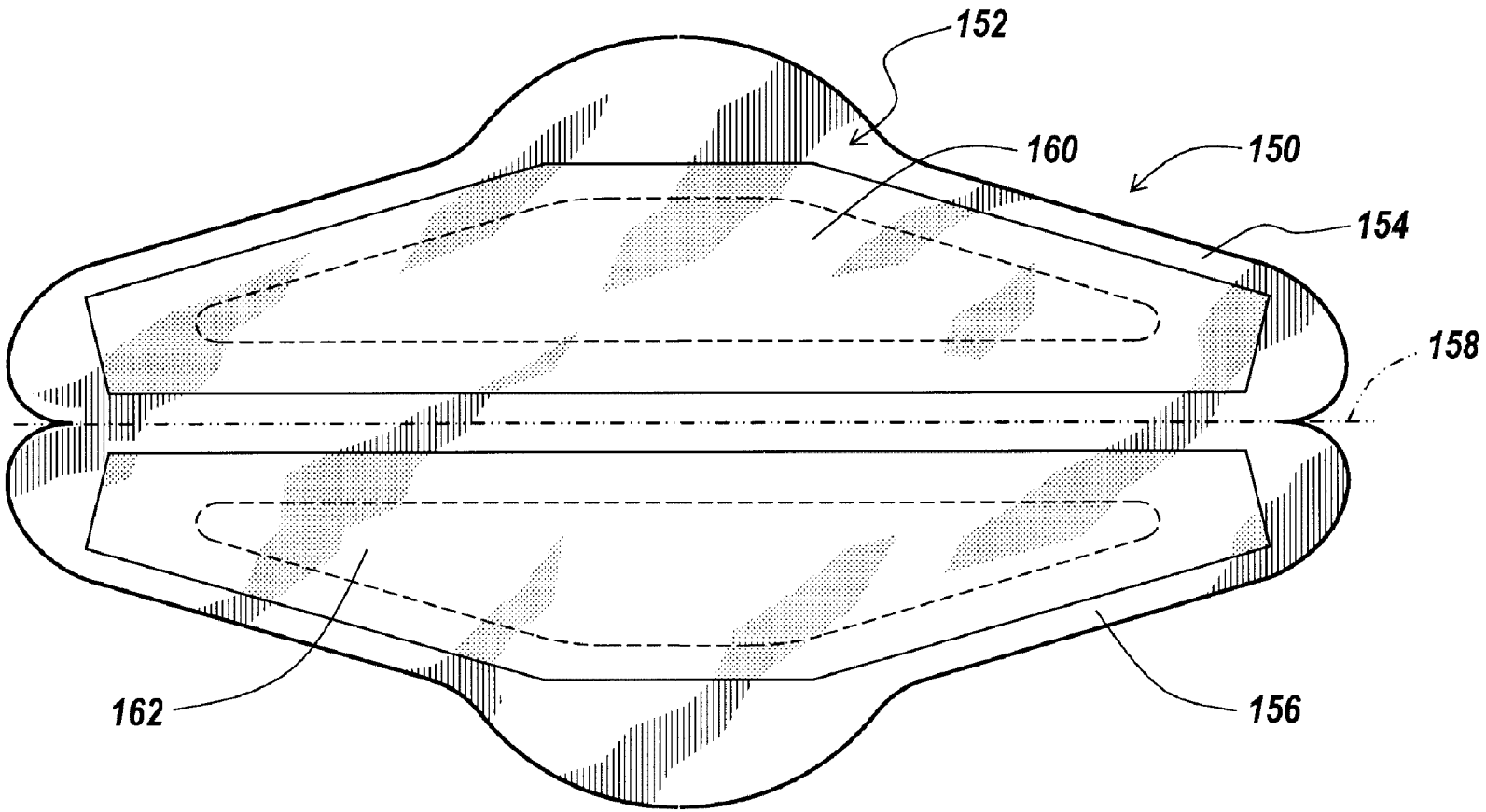
FIG. 9 is a front plan view of the clam case in its open condition.
Figure 10:
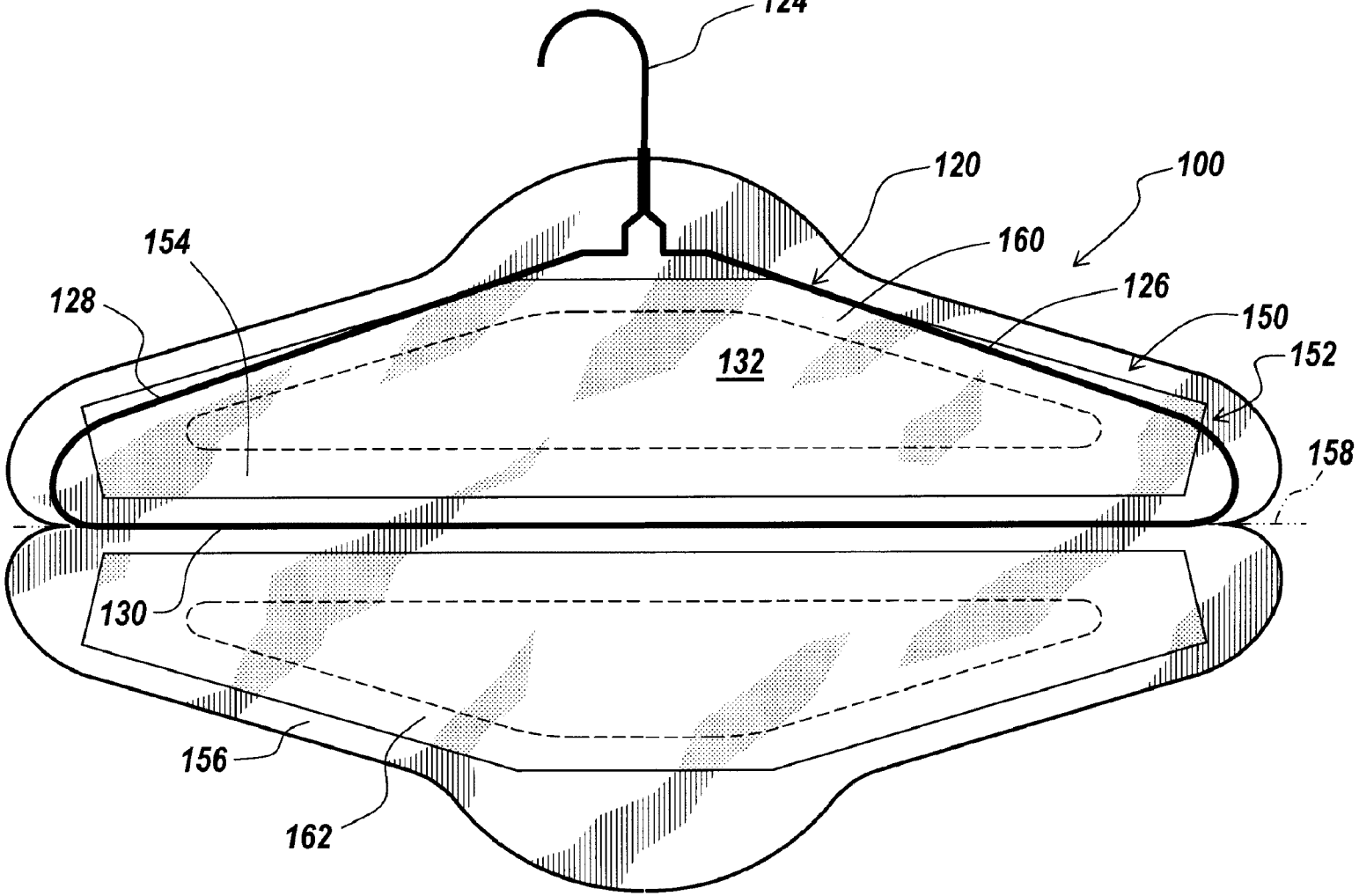
FIG. 10 is a front plan of the clam case in open condition with a hanger member placed therein.
Figure 11:
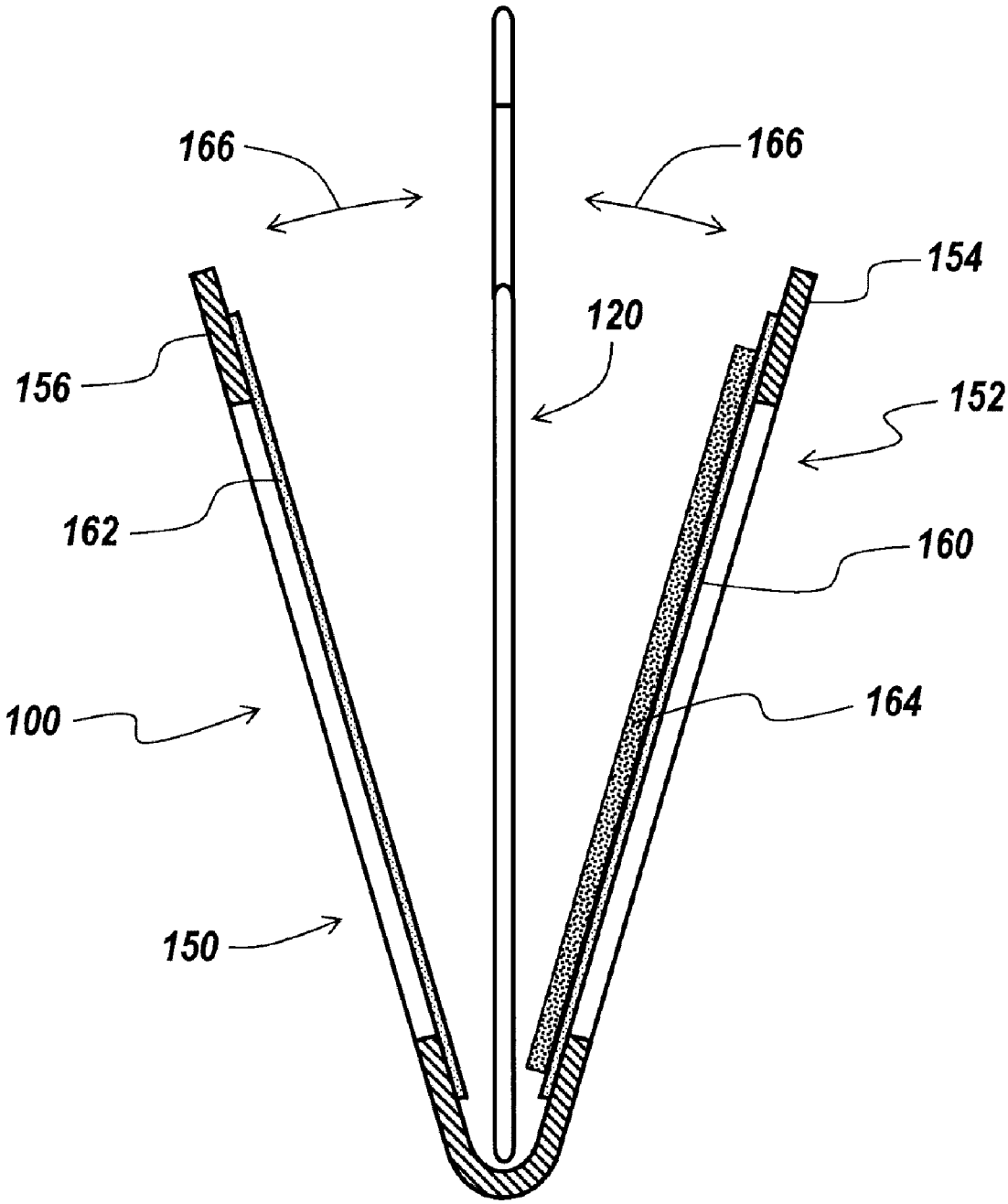
FIG. 11 is a side pictorial view of the clam case partially closed about the hanger member.

Referring now to the FIGS. 1-7, generally designated at 10 is one presently preferred embodiment of a garment refreshing hanger in accord with the present invention. The garment refreshing hanger 10 includes a hanger element generally designated 20 and a replaceable odor absorbing element generally designated 50.

The hanger element 20 includes hook 22 and downwardly and laterally extending garment suspension arms 24, 26. The garment suspension arms 24, 26 of the hanger 20 are shaped to provide a hollow torso generally designated 28 beneath and between the garment suspension arms 24, 26. The hollow torso 28 defines an air plenum in which odors may accumulate by air convection from targeted neck and underarm areas of a garment, not shown. A web generally designated 30 extends between and connects the garment suspension arms 24, 26 at their bottom ends.

The hanger element 20 includes mating, interfitting and interlocking front and back hanger bodies 32, 34. The front and back hanger bodies 32, 34 preferably are formed of injection molded thermoplastic material.

Air permeable screens 36, 38 are adhesively fastened to the inside of respective hanger bodies 32, 34. The air permeable screens 36, 38 are preferably of plastic or air-permeable fabric. Each of the screens 36, 38 and/or hanger bodies 32, 34 may be provided with printed or other indicia, not shown, to serve an advertising, identifying or other use. Alternatively, the screens may be intricately formed, for example as a honeycomb grille, together with the hanger bodies 32, 34.

The front and back hanger bodies 32, 34 cooperate to provide a slot generally designated 40 that extends along and through the web 30. The slot 40 provides removable insertion of the odor absorbing element 50 into and out of the hanger element 20 as illustrated by arrows 42. A cut-out generally designated 44 is centrally provided along the web 30.

The odor absorbing element 50 includes an elongated strip generally designated 52 having a U-shaped cross-section, and porous, activated carbon impregnated sheet material 54 attached to and extending from the strip 52. The activated carbon impregnated sheet material 54 substantially conforms in shape to and is substantially coextensive with the air plenum of the hollow torso 28 of the hanger element 20. Preferably, the activated carbon impregnated sheet material is activated carbon filter cloth.

Holes generally designated 56 are provided in spaced apart relation along the bottom edge of the porous activated carbon sheet material 54. Posts 58 are provided in spaced apart relation along the strip 52. The holes 56 cooperate with the posts 58 to attach the sheet material 54 to the strip 52.

A laterally outwardly extending flange 60 is centrally provided along the strip 52. The flange extension 60 provides a hand grip that sits in the cut-out 44 of the web 30 when the odor absorbing element 30 is seated in the hanger element 20.

Laterally outwardly directed resilient fingers 62 are provided in spaced apart relation along the strip 52. Inwardly opening slots generally designated 64 are provided in spaced apart relation along the walls providing the slot 40 carried by the web 30. The resilient fingers 62 cooperate with the slots 64 to releasably latch the odor absorbing element 50 when it is in slidably inserted condition and to permit its removal out of the hanger element 24 for disposal and/or at times of replacement by a fresh odor absorbing cartridge element.

Referring now to the FIGS. 8-11, generally designated at 100 is another presently preferred embodiment of a garment refreshing hanger in accord with the present invention. The garment refreshing hanger 100 includes a hanger element generally designated 120 and a replaceable odor absorbing element generally designated 150. The hanger element 120 preferably is a standard wire hanger 122 having a hook head 124, garment suspending shoulders 126, 128, a bottom web 130, and a hollow torso generally designated 132.

The odor absorbing element 150 includes a preferably plastic clam case generally designated 152 having open sidewalls 154,156 that are pivotally articulated along a common bottom edge illustrated by dashed line 158. Porous screens 160, 162 are adhesively attached respectively to the insides of the open sidewalls 154, 156 and an activated carbon impregnated porous sheet material 164 that conforms in shape to, and is substantially coextensive with the included air plenum of, the hollow torso 132 of the hanger element is adhesively or otherwise attached to the open sidewall 154 inside of the screen 160.

When in its open condition, the hanger 122 is inserted into the open clam case 150 and the case is pivoted to its closed condition as schematically illustrated by arrows 166. Snap releases, not shown, or other means to latch the case closed while permitting it to be reopened may be employed. The procedure is repeated at the time of disposal and/or replacement with a fresh odor absorbing element.

Figure 12:
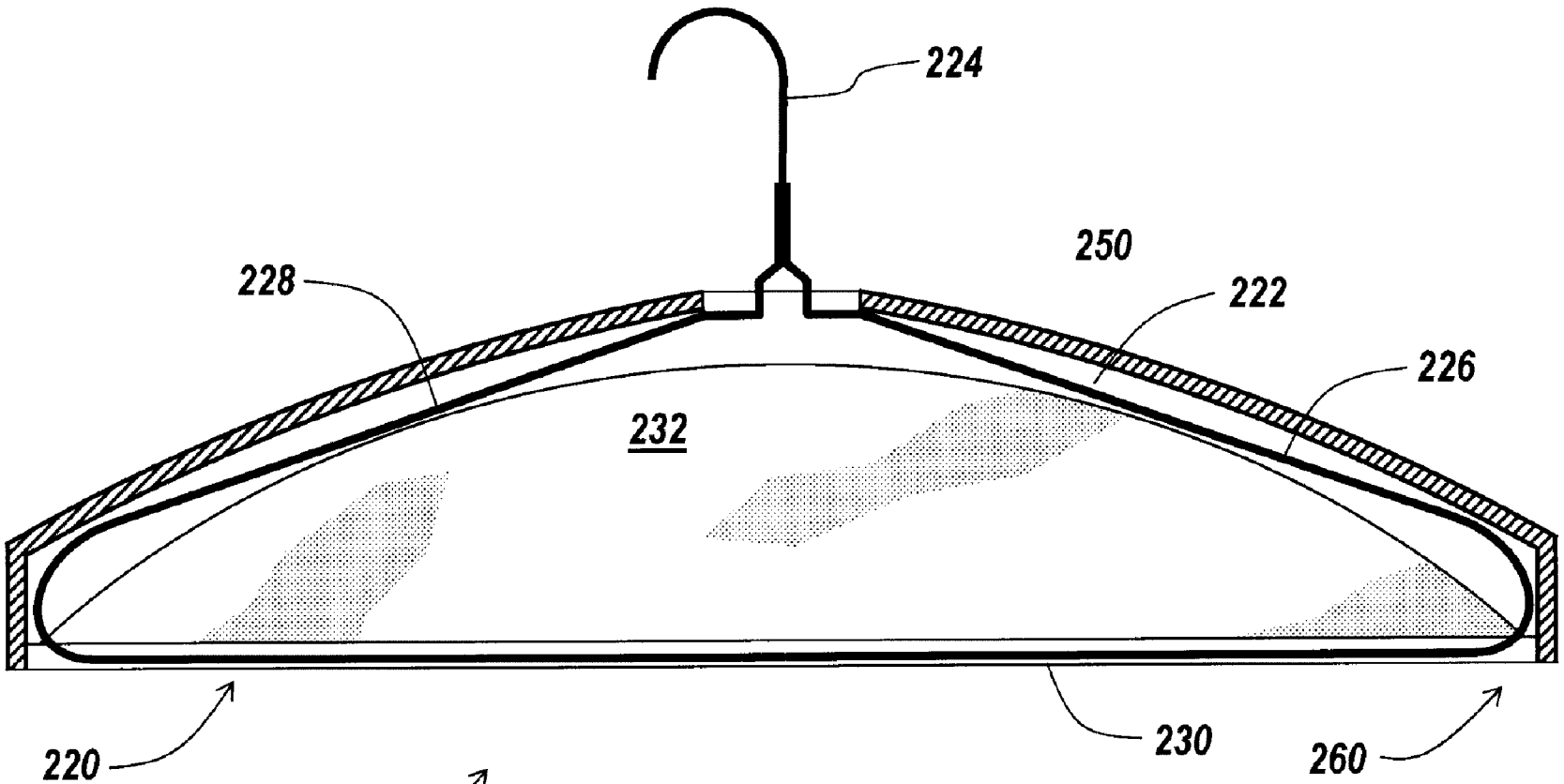
FIG. 12 is a front plan view of another presently preferred embodiment of a garment refreshing hanger in accord with the present invention, wherein the odor absorbing element includes a jacket slidably received over the hanger element.
Figure 14:
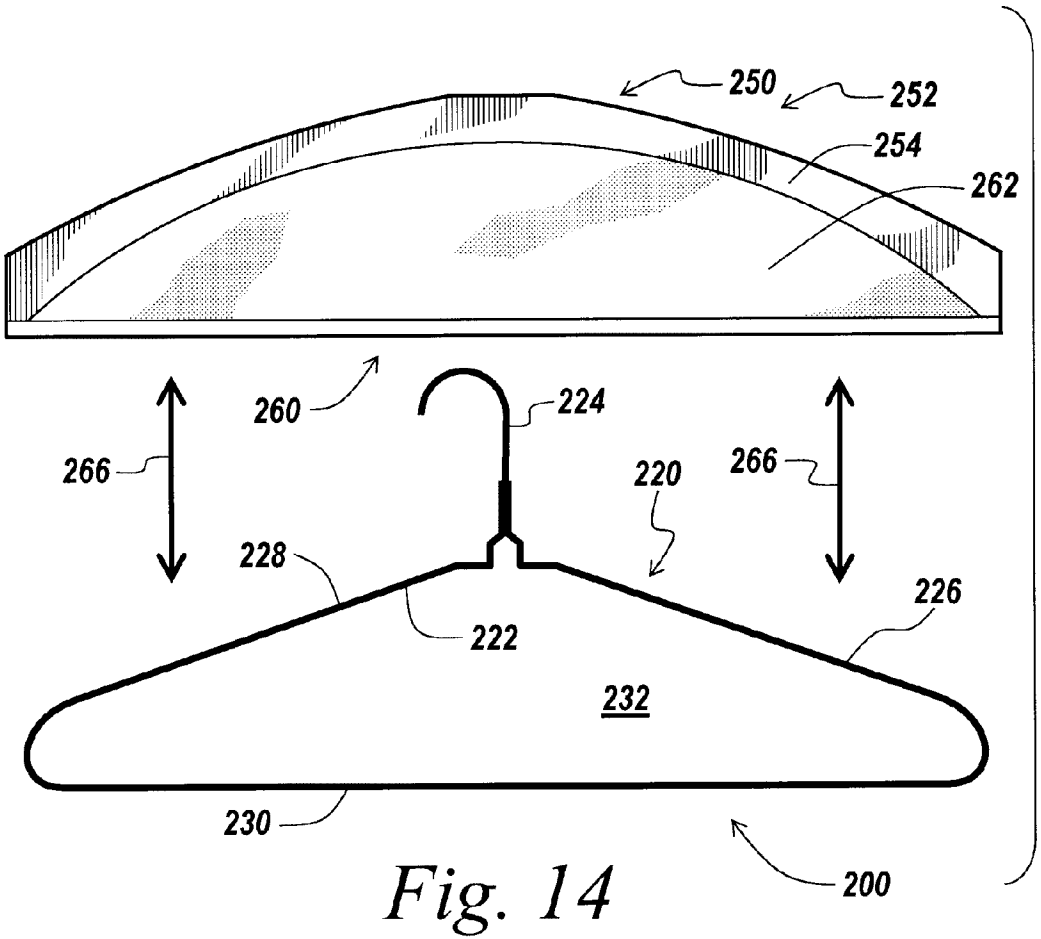
FIG. 14 is a front plan view illustrating the manner that the jacket is slidably received over the hanger element.
Figure 13:
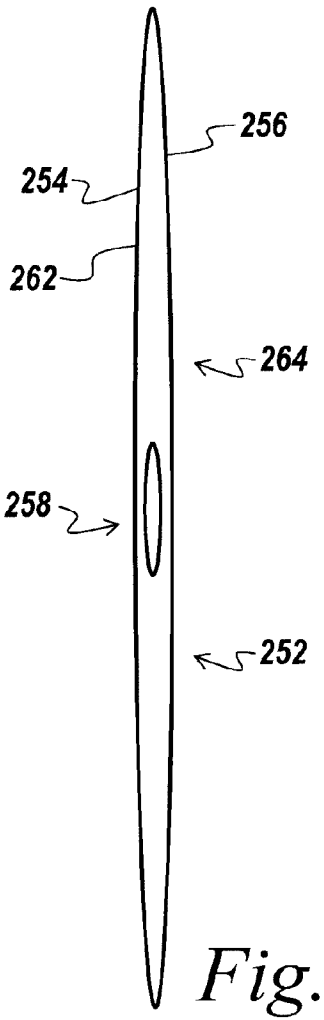
FIG. 13 is a top plan view of the jacket thereof.

Referring now to the FIGS. 12-14, generally designated at 200 is another presently preferred embodiment of a garment refreshing hanger in accord with the present invention. The garment refreshing hanger 200 includes a hanger element generally designated 220 and a replaceable odor absorbing element generally designated 250. The hanger element 220 preferably is a standard wire hanger 222 having a hook head 224, garment suspending shoulders 226, 228, a bottom web 230, and a hollow torso generally designated 232.

The odor absorbing element 250 includes a jacket generally designated 252 having open sidewalls 254, 256, an open hook head receiving opening generally designated 258 at the top and an hanger element receiving open bottom generally designated 260. The jacket 252 preferably is an air-permeable plastic or fabric material.

Porous screens 262, 264, preferably of plastic or air-permeable fabric, are adhesively or otherwise attached respectively to the insides of the open faces 254, 256 and an activated carbon impregnated porous fabric, not shown, that conforms in shape to and is substantially coextensive with the air plenum of the hollow torso 232 of the hanger element 220 is adhesively or otherwise attached to one of the open sidewalls of the jacket 252.

In use, the hanger 222 is inserted into the open bottom 260 of the jacket 252 till its hook end 224 extends out the opening 258 and the jacket is seated on the shoulders 226, 228 thereof as schematically illustrated by the arrows 266. At the time of disposal and/or replacement by a jacket having a fresh charge of deodorizing activated carbon impregnated sheet material, the consumed jacket is lifted off and replaced by another, fresh jacket. Alternatively, a fresh activated carbon impregnated sheet is replaced in the existing jacket.

Figure 15:
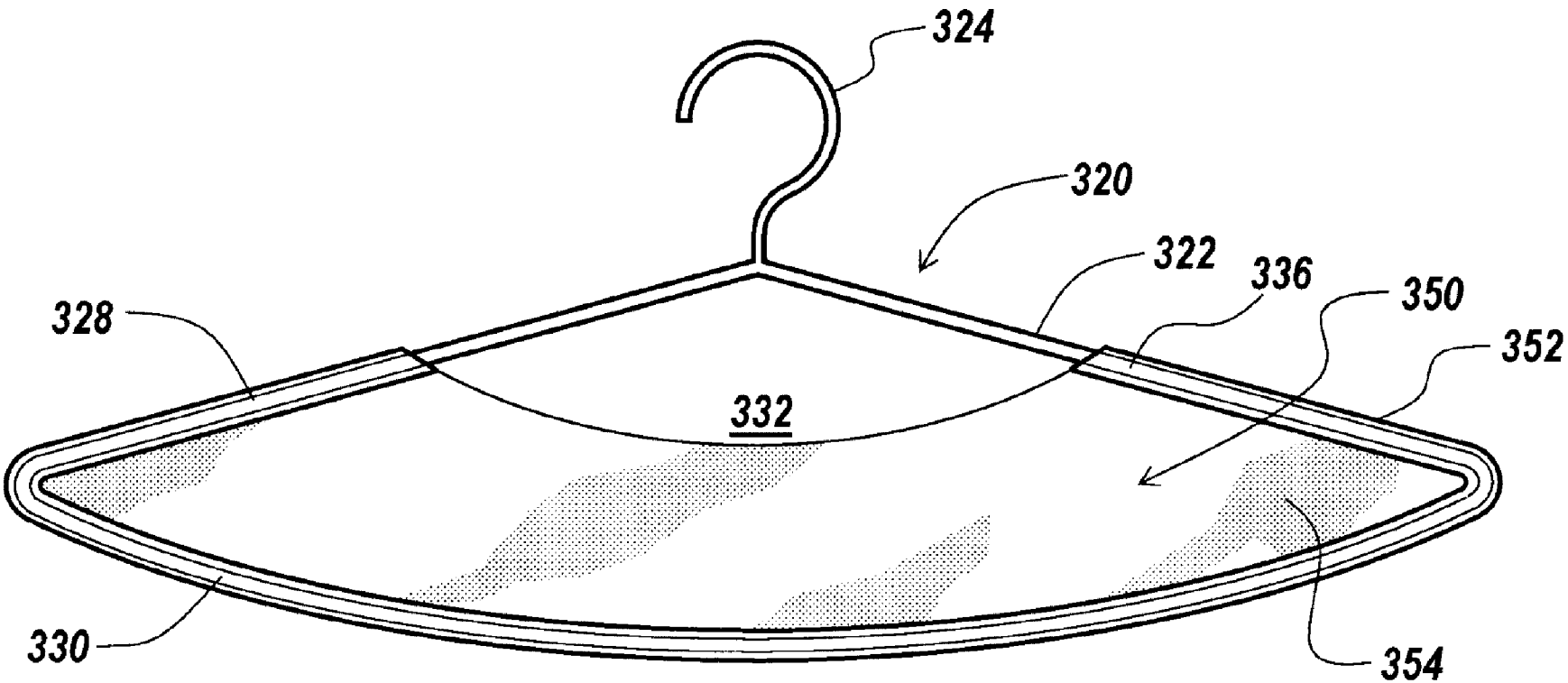
FIG. 15 is a front plan view of another presently preferred embodiment, wherein the odor absorbing element includes a resilient skirt.

Referring now to the FIG. 15, generally designated at 300 is another presently preferred embodiment of a garment refreshing hanger in accord with the present invention. The garment refreshing hanger 300 includes a hanger element generally designated 320 and an odor absorbing element generally designated 350. The hanger element 320 preferably is a standard wire hanger 322 having a hook head 324, garment suspending shoulders 326, 328, a bottom web 330, and a hollow torso generally designated 332.

The odor absorbing element 350 includes a resilient skirt 352 having porous, resilient sidewalls 354 preferably impregnated with an activated carbon material, not shown. The sidewalls conform in shape to a major portion of the hollow torso 332 of the hanger element. Alternately, activated carbon sheet material, not shown, that conforms in shape to the open torso may be positioned between and retained by the side walls in the air plenum defined by the hollow torso of the hanger.

In use, the resilient skirt 352 is stretched over, seated onto and then adhesively fastened along its edges or otherwise attached to the hanger 320. After consumption of its active odor absorbing material, the hanger 300 is disposed of or may be used as an ordinary, non-odor-absorbing garment hanger. The resilient skirt alone can also be removed and replaced on the existing hanger when odor absorbing effectiveness has expired in an alternative embodiment.

Figure 16:
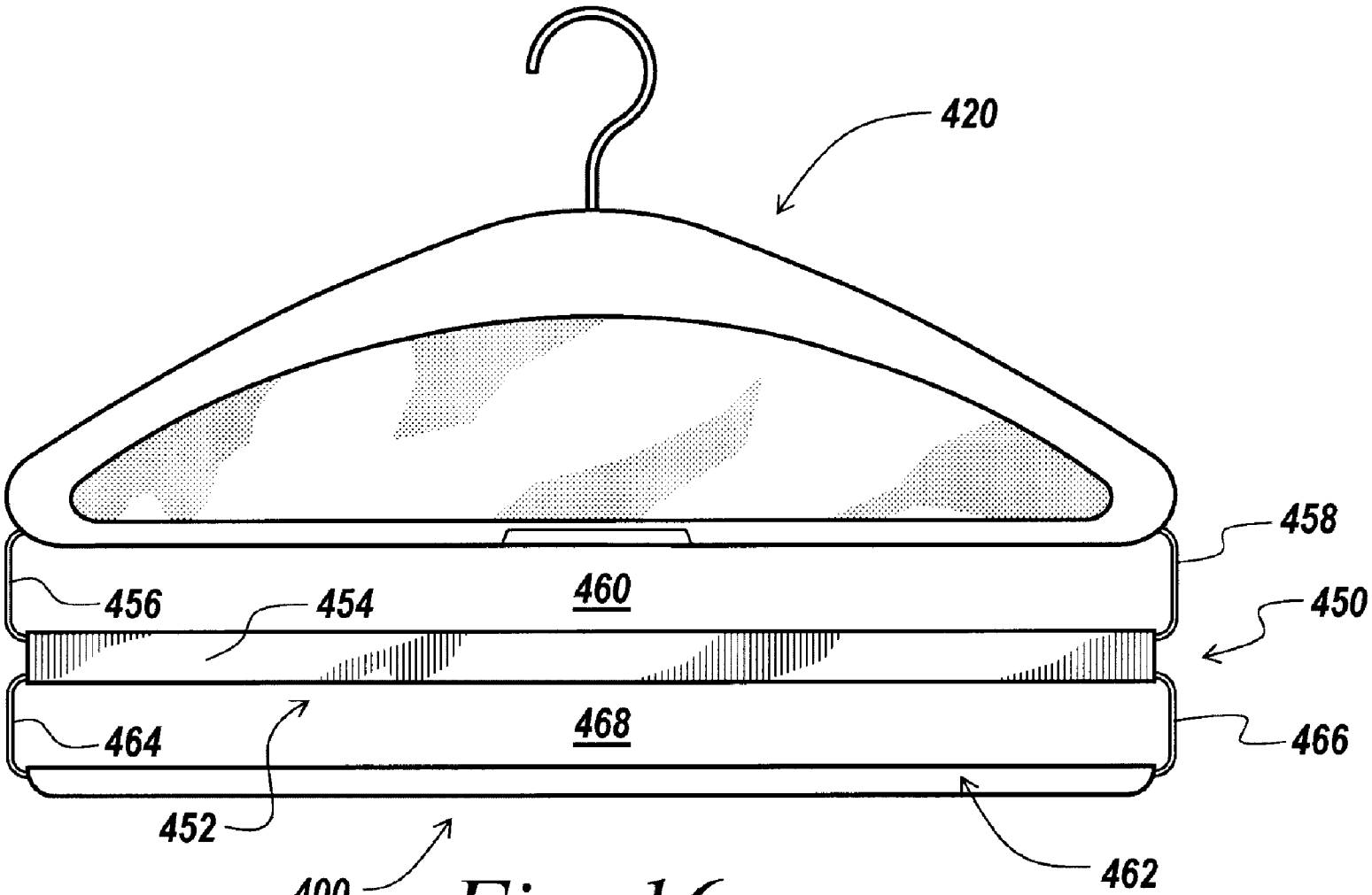
FIG. 16 is a front perspective view of the embodiment of FIGS. 1-7, modified to include an odor absorbing crotch and seat extension.

Referring now to FIG. 16, generally designated at 400 is another embodiment of the garment refreshing hanger of the present pension. The garment refreshing hanger 400 includes an odor absorbing hanger generally designated 420, of the type described above in connection with the description of the embodiment of the FIGS. 1-7, modified to include an odor absorbing crotch and seat extension generally designated 450. The odor absorbing hanger 420 is not described again for the sake of brevity of explanation. It is understood a different garment refreshing hanger embodiment in accord with the present invention may be provided with a crotch extension without departing from the inventive concepts. Alternatively, the crotch and seat extension may be deployed from a conventional garment hanger.

The extension 450 includes a rail 452 and an odor absorbing activated carbon impregnated flexible sheet material 454 wrapped therearound. A pair of struts 456, 458 attach the rail 452 in spaced apart relation to the hanger 420 providing an opening generally designated 460 between the hanger 420 and the rail 452.

A rail generally designated 462 is attached in spaced apart relation to the rail 452 by a pair of struts 464, 466 providing an opening generally designated 468 between the rails 452, 462. The openings 460, 468 respectively receive each leg of a pair of trousers, not shown, such that the crotch and seat thereof is brought into close proximity to and so deodorized by the material 454.

Figure 17:
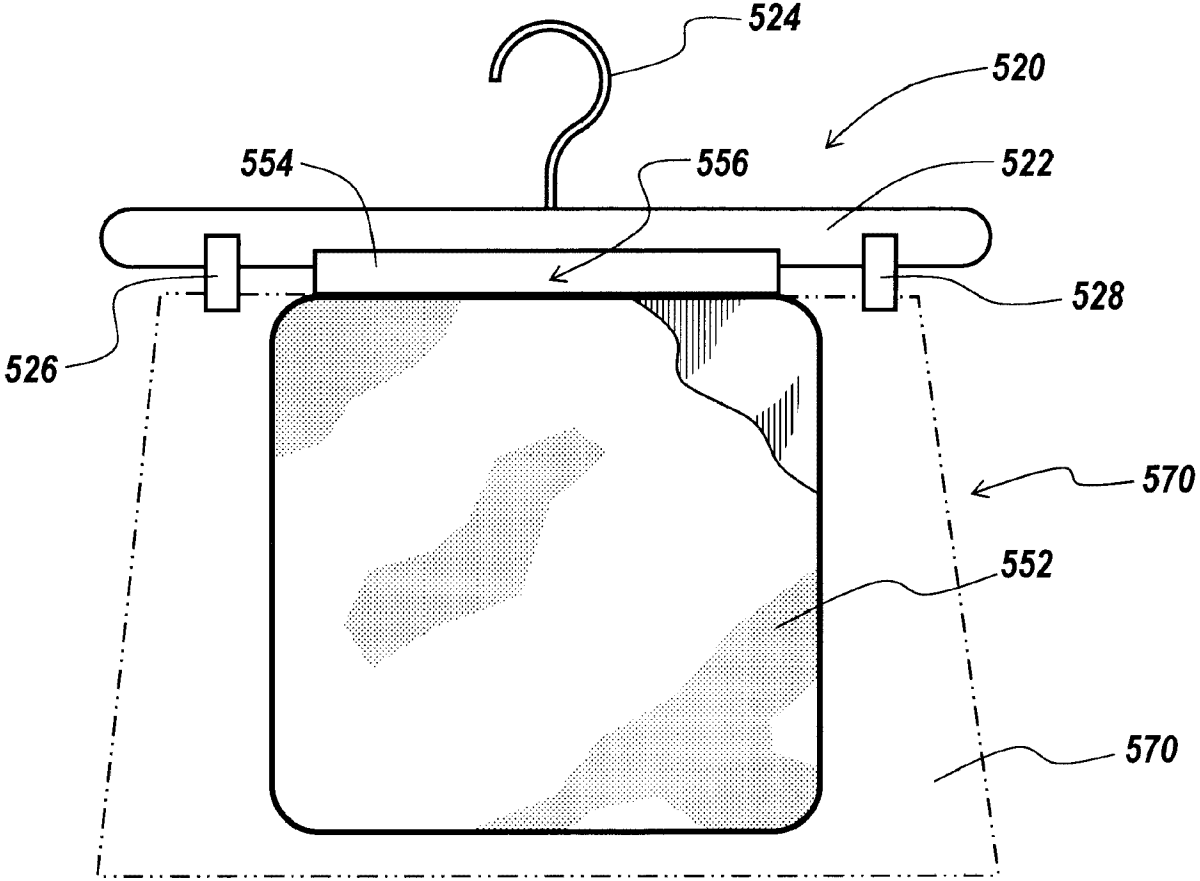
FIG. 17 is a front pictorial view of a skirt refreshing hanger.

Referring now to FIG. 17, generally designated at 500 is a skirt refreshing hanger. The skirt refreshing hanger 500 includes a hanger element generally designated 520 and an odor absorbing element generally designated 570. The hanger element 520 has a horizontally extending arm 522 to which a hook 524 is attached for hanging. Releasable skirt attaching clips 526, 528 are carried at opposing ends of the arm 522.

The odor absorbing element 552 includes a clip 556 attached to the underside of the arm 522 and a porous activated carbon impregnated flexible sheet material 552 removably retained in the jaws of the clip 556. The activated carbon impregnated material 552 absorbs odors from inside a skirt illustrated in dashed outline 570 supported by the clips 526, 528. Alternately, the odor absorbing element 552 could be deployed from any garment refreshing hanger in accord with the present invention.

Many modifications of the presently disclosed invention will become apparent to those skilled in the art without departing from the inventive concepts. For example, although the hanger and odor absorbing elements of the presently preferred embodiments are provisioned as separate subassemblies, it will be appreciated that they may be embodied as functionally differentiated though not necessarily physically separated hanger and odor absorbing elements. Although activated carbon impregnated fabric is presently preferred, the odor absorbing material of the odor absorbing element may be otherwise embodied so long as it is conformably shaped to, and substantially coextensive with at least a major portion of, the plenum of the hollow torso of the hanger element (e.g., by using loose granular or pelletized activated carbon material or baking soda). A wide range of hollow torso profiles may be employed. In embodiments where the odor absorbing element is replaceable, a wide variety of removable mounting means other than those of the presently preferred and exemplary embodiments will become apparent to those of skill in the art having benefitted by the present invention. As an example, in the embodiment of FIGS. 1-7, the U-shaped handle strip attached to the activated carbon sheet material could be dispensed with altogether, the activated carbon sheet material thereof could itself be slidably mounted through the open bottom web thereof, and one end of an arm substantially coextensive with the bottom web could be pivotally attached to the confronting end of the bottom web to serve as a door holding the activated carbon in place and allowing its replacement.

What is claimed is:

1. A garment refreshing hanger deodorizing underarm and neck target high odor areas, comprising:

a hanger element, the hanger element including a suspension head and garment suspension arms connected to the suspension head providing a hollow torso below and between the garment suspension arms defining an air plenum in which garment odors may accumulate by air convection; and an odor absorbing element, the odor absorbing element including activated carbon material such that the activated carbon material is conformably shaped to the hollow torso and substantially coextensive with the air plenum below and between the garment suspension arms to absorb garment odors that waft into the air plenum of the hollow torso by air convection from underarm and neck target high odor areas wherein the odor absorbing element includes a jacket open at both bottom and top and having air permeable side walls that slidably receives and is seated upon the hanger element.

2. The garment refreshing hanger of claim 1, wherein said odor absorbing element is replaceable upon activated carbon consumption.

3. The garment refreshing hanger of claim 1, wherein said air permeable side walls include porous screens.

4. The garment refreshing hanger of claim 1 wherein the hanger element includes a wire hanger member.

5. The garment refreshing hanger of claim 1, wherein the activated carbon material is an activated carbon impregnated fabric material.

6. The garment refreshing hanger of claim 1, further including a crotch and seat deodorizing part attached to and extending below the hanger element.

7. The garment refreshing hanger of claim 1, further including a skirt deodorizing part attachable to and extending from the hanger element.

* * * * *